US010967672B2

(12) United States Patent
Mayberry

(10) Patent No.: US 10,967,672 B2
(45) **Date of Patent: *Apr. 6, 2021**

(54) PAINT PALETTE SYSTEM

(71) Applicant: TULKO HARDWARE, LLC, Tulsa, OK (US)

(72) Inventor: Ben Michael Mayberry, Tulsa, OK (US)

(73) Assignee: TULKO HARDWARE, LLC, Tulsa, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/673,244

(22) Filed: Nov. 4, 2019

(65) Prior Publication Data

US 2020/0198391 A1 Jun. 25, 2020

Related U.S. Application Data

(63) Continuation of application No. 15/598,571, filed on May 18, 2017, now Pat. No. 10,464,368, which is a continuation of application No. 13/815,658, filed on Mar. 14, 2013, now Pat. No. 9,656,513.

(60) Provisional application No. 61/685,281, filed on Mar. 15, 2012.

(51) Int. Cl.
*B44D 3/02* (2006.01)
*B44D 3/12* (2006.01)

(52) U.S. Cl.
CPC ..... *B44D 3/02* (2013.01); *B44D 3/123* (2013.01)

(58) Field of Classification Search
CPC ..... B44D 3/02; B44D 3/123; A63B 59/02; A63B 59/025; A63B 67/06; A63B 2208/12
USPC ..... 206/1.7–1.9; 237/348.4; 15/210.1, 15/244.1, 146, 230, 257.05–257.06
See application file for complete search history.

(56) References Cited

U.S. PATENT DOCUMENTS

| | | | | |
|---|---|---|---|---|
| 2,853,731 | A * | 9/1958 | Lancaster | B05C 17/00 15/210.1 |
| 2,878,590 | A | 3/1959 | Dodge | |
| 2,932,906 | A | 4/1960 | Chamberlin | |
| 3,593,951 | A | 7/1971 | Warner | |
| 3,757,990 | A | 9/1973 | Buth | |
| 3,874,499 | A | 4/1975 | Barnett, Jr. | |
| 3,983,993 | A | 10/1976 | Hsu | |

(Continued)

FOREIGN PATENT DOCUMENTS

| | | |
|---|---|---|
| DE | 644271 | 4/1937 |
| DE | 644271 C | 4/1937 |

(Continued)

OTHER PUBLICATIONS

European Extended Search Report for Application No. EP16181225.0, dated Oct. 18, 2017, 7 pages.

*Primary Examiner* — Chun Hoi Cheung
*Assistant Examiner* — Brijesh V. Patel
(74) *Attorney, Agent, or Firm* — McAndrews, Held & Malloy, Ltd.

(57) ABSTRACT

A paint palette system for holding and dispersing paint wherein a painter can pour paint into a low profile receptacle for later removal with a paintbrush or like tool is provided. A disposable and removable paint retaining fabric retains the paint in a drip-less and mess free fashion. The paint can be transported and stored in an improved manner allowing for a faster and more efficient painting effort.

20 Claims, 6 Drawing Sheets

(56) References Cited

U.S. PATENT DOCUMENTS

| | | | | | |
|---|---|---|---|---|---|
| 4,127,911 | A | * | 12/1978 | Cupp | B05C 17/00 15/144.1 |
| 4,638,909 | A | | 1/1987 | Ford | |
| 4,658,461 | A | * | 4/1987 | Roe | B05C 17/00 15/144.1 |
| 4,729,143 | A | | 3/1988 | Dawson | |
| 4,911,642 | A | | 3/1990 | Knowles | |
| 5,316,311 | A | | 5/1994 | Lee | |
| 5,331,710 | A | * | 7/1994 | Tollasepp | A46B 9/02 15/144.1 |
| 5,351,812 | A | | 10/1994 | Eagon | |
| 5,362,066 | A | | 11/1994 | Sassak | |
| 5,460,289 | A | | 10/1995 | Gemmell | |
| 5,484,637 | A | | 1/1996 | Paragon | |
| 5,511,279 | A | | 4/1996 | Ippolito | |
| 5,645,164 | A | | 7/1997 | Hocking | |
| 5,646,164 | A | | 7/1997 | Hocking | |
| 5,715,933 | A | | 2/1998 | Monahan | |
| 5,933,905 | A | * | 8/1999 | Hess | B05C 17/00 118/264 |
| D417,584 | S | | 12/1999 | Lillelund | |
| 6,076,225 | A | | 6/2000 | Sorenson | |
| 6,302,267 | B1 | | 10/2001 | Monahan | |
| 6,325,206 | B1 | | 12/2001 | Stonex | |
| 6,530,107 | B2 | * | 3/2003 | Kim | B05C 17/00 15/145 |
| 6,546,584 | B2 | * | 4/2003 | Hobden | B05C 17/00 15/144.1 |
| 6,604,742 | B2 | | 8/2003 | El Sabbagh | |
| 6,679,398 | B1 | | 1/2004 | O'Brien | |
| 6,802,715 | B1 | | 10/2004 | Wotton | |
| 6,865,769 | B1 | | 3/2005 | Sorenson | |
| 6,991,829 | B2 | | 1/2006 | Bergman | |
| 7,040,498 | B2 | | 5/2006 | Rickman | |
| 7,717,483 | B1 | | 5/2010 | Bombara | |
| 7,721,910 | B2 | | 5/2010 | Wallace | |
| 7,950,335 | B1 | | 5/2011 | Almond | |
| 8,321,989 | B1 | | 12/2012 | McClanahan | |
| 8,556,116 | B2 | | 10/2013 | Bergman | |
| 9,566,602 | B2 | * | 2/2017 | MacCormick | A46B 9/02 |
| 2004/0168954 | A1 | | 9/2004 | Hannan | |
| 2004/0195248 | A1 | | 10/2004 | Gardia | |
| 2005/0217034 | A1 | | 10/2005 | Miller | |
| 2006/0032780 | A1 | | 2/2006 | Heyn | |
| 2007/0029215 | A1 | | 2/2007 | Martinez | |
| 2010/0140275 | A1 | | 6/2010 | Billado, Jr. | |
| 2010/0252459 | A1 | | 10/2010 | DeHart | |
| 2011/0297685 | A1 | | 12/2011 | Sorenson | |
| 2013/0057005 | A1 | | 3/2013 | Grieve | |
| 2014/0262840 | A1 | | 9/2014 | Mayberry | |

FOREIGN PATENT DOCUMENTS

| | | |
|---|---|---|
| DE | 726618 | 10/1942 |
| DE | 726618 C | 10/1942 |

* cited by examiner

PAINT PALETTE SYSTEM

CROSS-REFERENCE TO RELATED APPLICATION

The present application is a continuation of U.S. patent application Ser. No. 15/598,571, filed May 18, 2017, which issued as U.S. Pat. No. 10,464,368, which is a continuation of U.S. patent application Ser. No. 13/815,658, filed Mar. 14, 2013, which issued as U.S. Pat. No. 9,656,513, which claims priority to U.S. Provisional Application Ser. No. 61/685,281, filed Mar. 15, 2012. Each of the above-mentioned prior-filed applications is hereby expressly incorporated herein by reference in its entirety.

BACKGROUND—FIELD OF THE INVENTION

This invention relates to a painters tool used for storing, holding and dispensing paints in an improved manner. In particular the invention relates to an improved low profile receptacle apparatus and system to carry paint from one location to another without spillage and to disperse paint to a brush or painting tool.

BACKGROUND—DISCUSSION OF PRIOR ART

A paint palette is a tool typically used by an artist and is used to provide a hand held platform typically made of wood or plastic on which the artist dabs acrylic paint for use when painting.

Typically, this is used only for artist painting upon a canvas and designed for the use of thicker acrylic paint that can be applied in dabs. This system works well for an artist painting in acrylics but a typical artist palette would not be suitable for someone painting a house.

While the artist palette will not generally work for a typical house painter it could offer a painter a useful way and tool to move paint from one location to another without spillage.

Unfortunately, if a mixture of house paints were to be applied to a painter's palette the result would lead to paint running and mixing together. Additionally the typical house paint would not easily remain on the palette if the palette were tilted.

In general, the prior art for painter tools designed to provide a palette tool or like has attempted to create paint palettes by focusing on producing small paint cavities or keeping paint retained within a sponge or a similar material.

Other prior art has utilized porous materials on which dabs of paint are placed, but still utilize a water retentive means such as a sponge material to keep the paint from drying out. None of these systems allow for easy storing and are not designed to retain the paint between extended uses.

Although these types of systems are adequate to maintain the paint dabs in a useable condition for short periods of time, they have a tendency to dry the paint from the top of the sponge, thereby necessitating the user to add water or oil to the palette in order to maintain the paint in a useable condition.

Additionally, house paint is often stored between uses for extended periods of time and typically needs to be transported to the various locations about a house wherein an artist palette typically remains in an art room.

Prior art has not shown us a useful means for transporting and storing or viewing paint colors while in storage. Additionally, prior art has not provided a truly useful painters tool that allows a painter a truly powerful tool to speed up the painting process in a neat and effective way.

Thus, there exists a need for a tool that can be used by painters comprising a paint palette system that can maintain paint in a moist and useable condition and also dispense paint to the paintbrush in a simple fashion while being easy to transport and store.

SUMMARY OF THE INVENTION

The paint palette system is a new system and tool long needed by painters and fills a need for both professional and non-professional painters. The invention provides an improved way to move paint around the house or up a ladder without spillage.

The paint palette system allows the painter to focus on painting and not on accidental spills or worrying where the paint bucket is located or accidentally knocking over a paint can. Focus can be on painting.

The paint palette system is so mess free that a child can paint without spilling paint. In testing the paint palette system the product was loaded with paint and thrown on a rooftop without any loss of paint or spillage.

The paint palette system allows for easy storage and reuse of paint. The complete paint palette system can be easily stored for extended periods of time in commercially available seal type plastic bags. It can be easily stored and the paint color can be easily viewed when needed again.

The paint palette system allows for the painter to worry less about mess and more about painting. The paint palette system allows for less trips to the paint can to reload the paintbrush. The paint palette system also saves the painter clean up and painting time.

A painter can now climb a ladder to paint a roof or elevated area without handling full cans of paint. A painter can even take two or more colors to remote locations without worrying about multiple cans.

The paint palette system offers a unique tool with many add-ons for holding a brush, squeegee or other tools and its novel design offers many improvements for painters and simplifies the painters' life.

Accordingly, several objects and advantages of the disclosed invention are provided including but not limited to an improved system or process wherein a house painter or like professional can paint in a more efficient and faster way.

Other objects and advantages of the invention include providing an apparatus for paint containment and dispensing that is spill proof and easily transported, as well as an apparatus that is easily manageable, carried and sealed for an extended time.

Additionally, the invention discloses an apparatus that can be easily held while transporting paint up and down a ladder and will retain paint even when tipped at an angle. The invention is also a low profile containment apparatus that allows it to be taken into very tight places and stored easily.

Another new and unique advantage of the invention is that multiple colors can be used together without the paints mixing and it can also be set upon a high pitch roof and will not slide off or spill the contained paint.

The apparatus can be tilted at a high degree and be turned upside down onto a drop cloth for an extended period of time to prevent air from drying the contained paint.

When in use, the system will not drip paint on unprotected surfaces. When used outside the apparatus can be held at any angle away from the sun to shield the paint from drying while painting outdoors. It can also be used to shield the sun out of the painters' eyes without spilling the contained paint.

The invention retains paint and will not spill or drip even when turned upside down and will additionally keep paint from being blown off the brush in windy conditions. This is due to less excess paint to remove from the brush.

Because of the improved design of the invention, the brush is loaded with paint in an improved fashion and the brush, roller, or other painting tools become easier to use and better disperses the paint. Less paint is wasted.

Paint storage also becomes easier, due to the low profile. The whole palette system can be contained in a commercially available plastic bag allowing for extended storage times between uses and additionally the clear plastic allows for ease of viewing paint colors stored.

Additionally, use of the apparatus minimizes the use of drop cloths because of its spill resistant design. Further objects and advantages of the invention will become apparent from consideration of the drawings and ensuing description.

Certain accessories may also be added to the invention as described and may include a strap across the base of the container so that a user may slide their hand between the strap and the container base. Other accessories may include a Squeegee, covering means and add-on attachments for managing a paint brush or other tools.

The foregoing and other objectives, features, and advantages of the invention will be more readily understood upon the consideration of the following detailed description of the invention.

DESCRIPTION OF THE INVENTION

Figure 2:
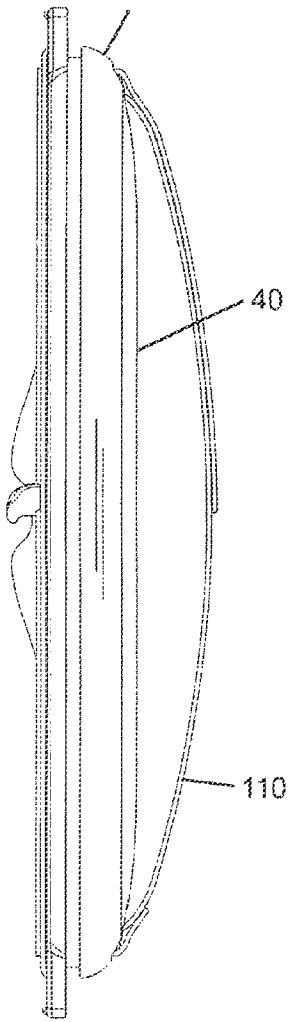
FIG. 2 is a right end view, the opposite side being a mirror image.
Figure 1:
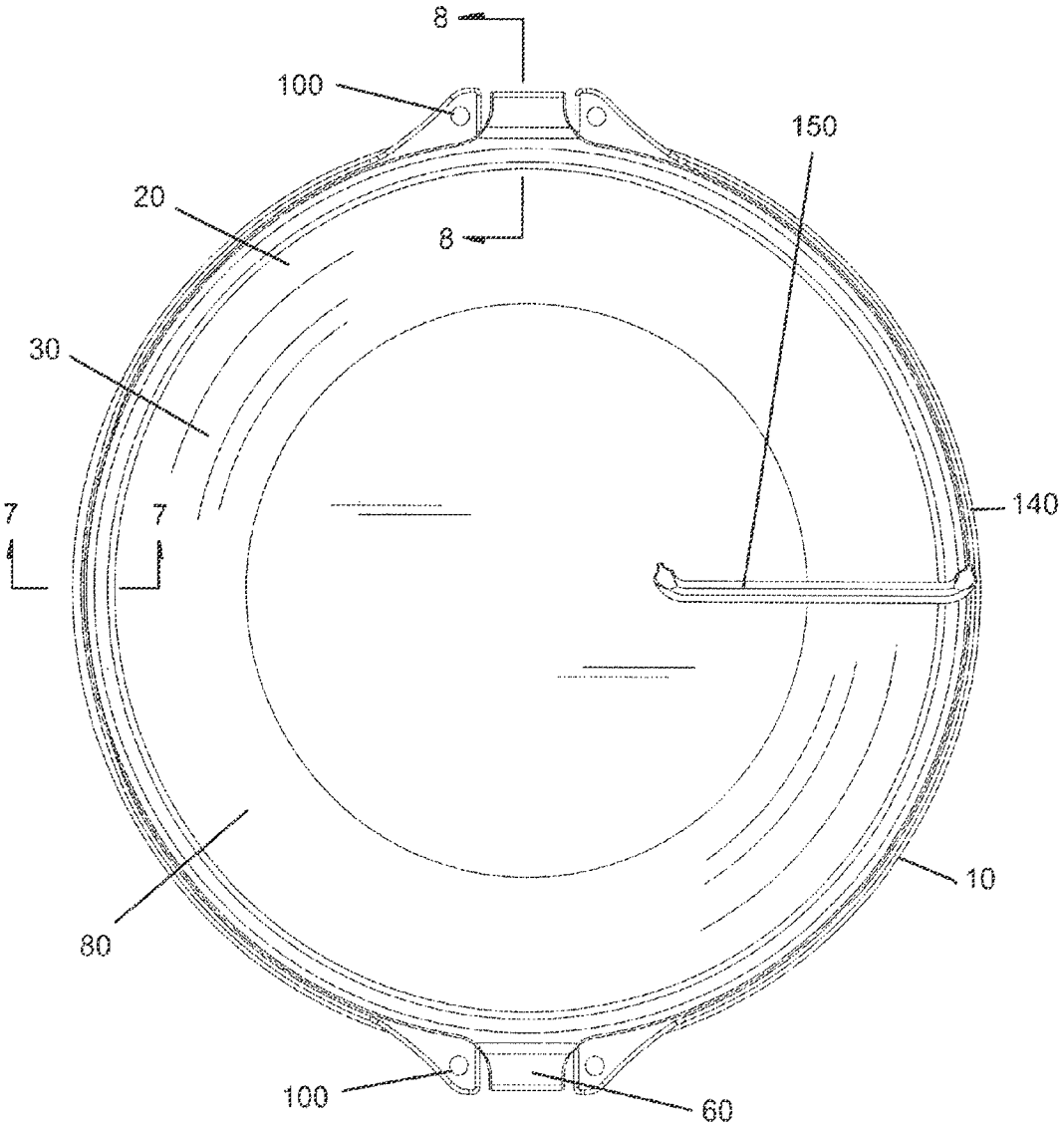
FIG. 1 is a top plan view.

FIG. 1 shows a top plan view of the basic embodiment of the paint palette system 10 wherein the main body of the paint palette system 10 comprises an open-top circular structure 20 comprising an open receptacle 30 constructed of a semi-rigid plastic material.

In the preferred embodiment, the paint palette system 10 has several fitting components including a semi-rigid outer structure comprising an open low profile structure designed for complementary receiving a liner 60 constructed of a thinner and lighter plastic material. The liner 60 may snap into the paint palette system 10. The liner 60 may be removable from the paint palette system 10.

Figure 5:
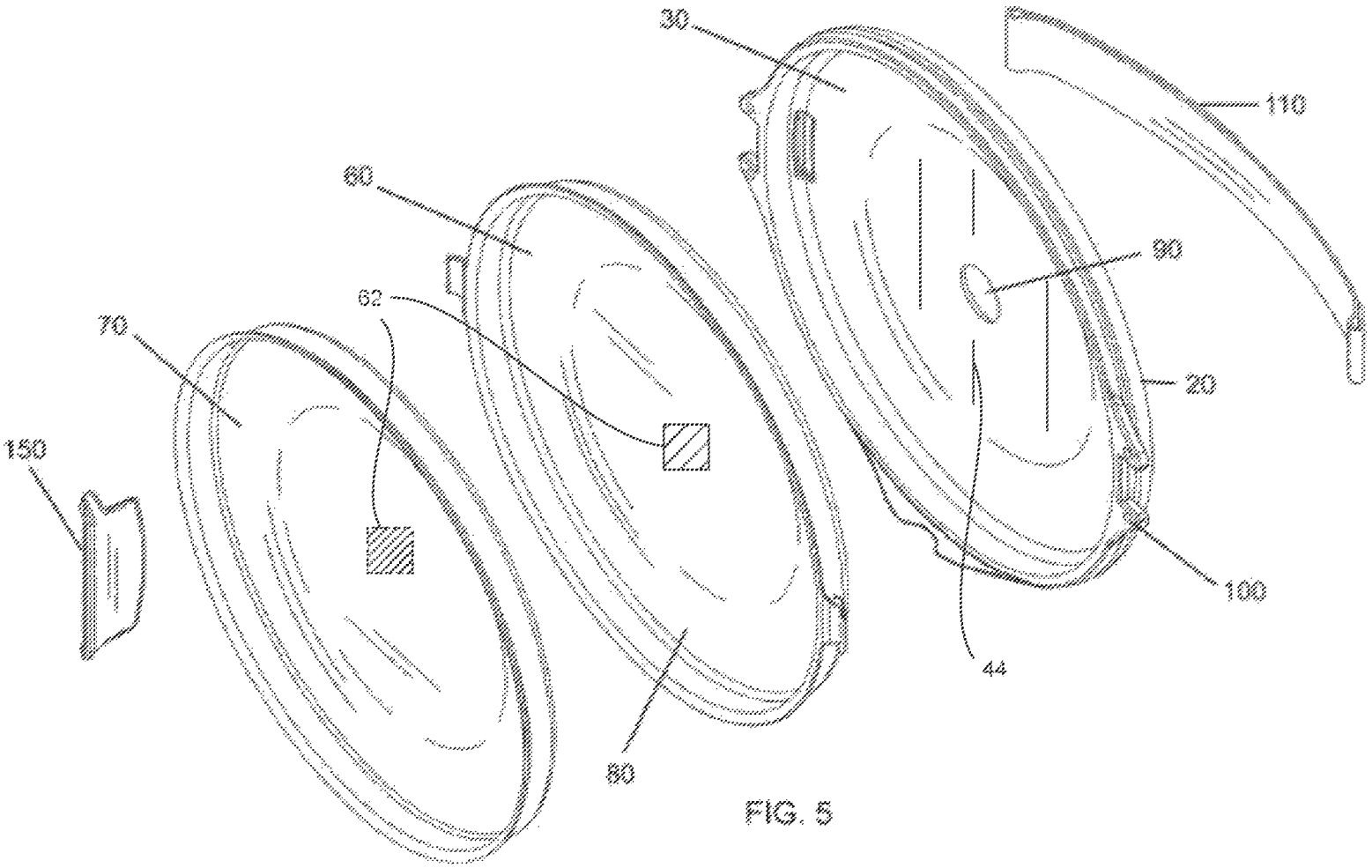
FIG. 5 is an exploded perspective view.
Figure 6:
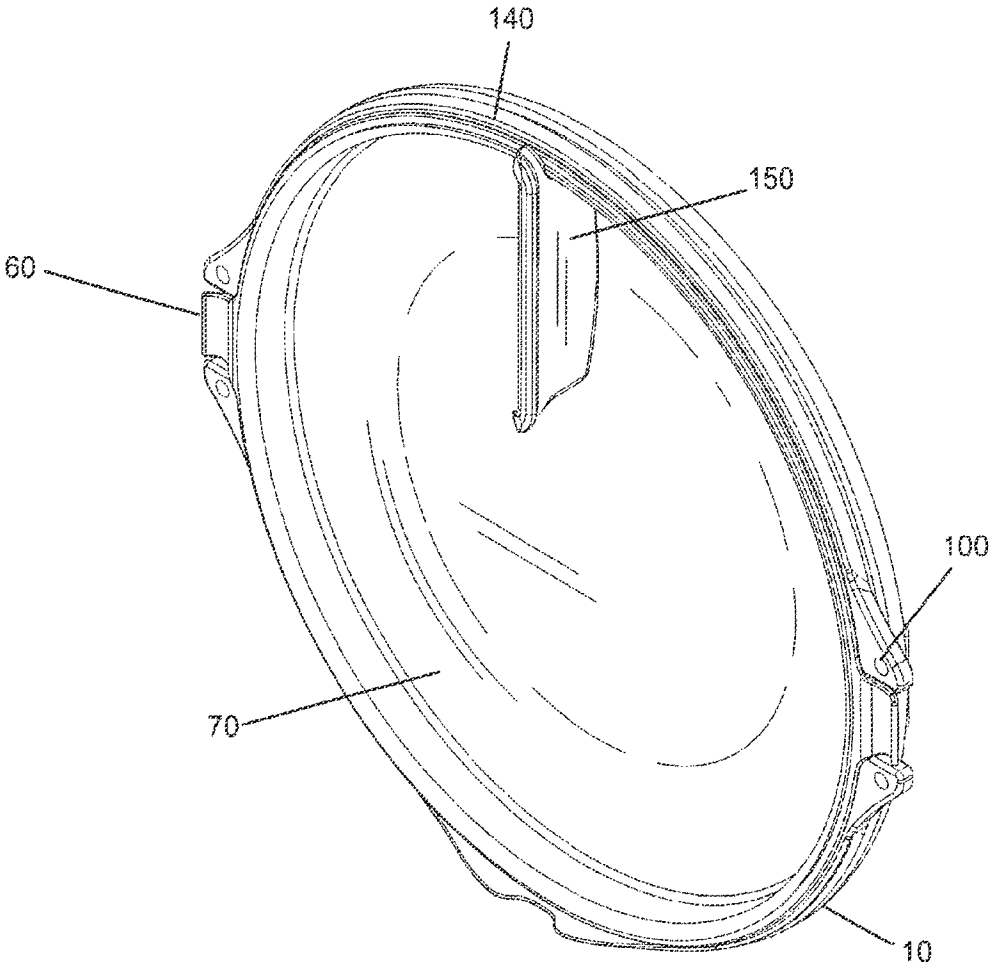
FIG. 6 is an assembled perspective view.
Figure 7:
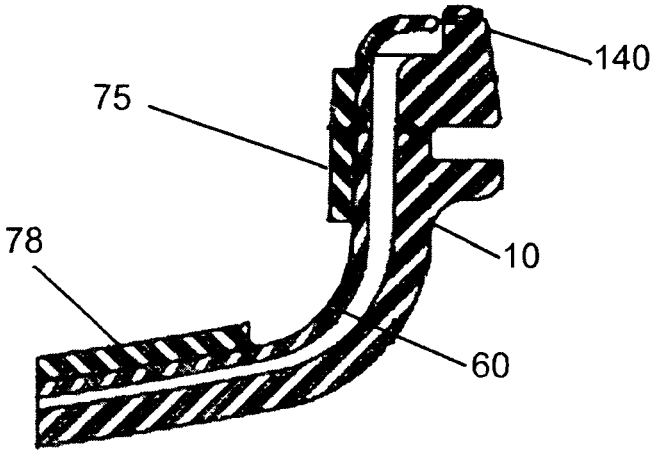
FIG. 7 is a sectional view taken from FIG. 1.
Figure 8:
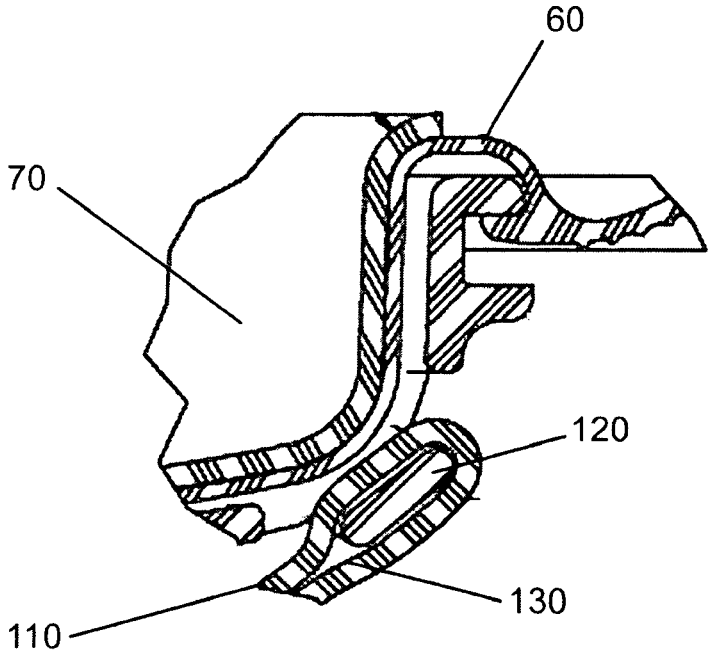
FIG. 8 is a sectional view taken from FIG. 1.

The liner 60 shall be designed to receive and have affixed within its interior a cut and formed bristle fabric 70 fitted within the interior cavity 80 of the liner 60 shown in FIG. 5. In the preferred embodiment, bristle fabric 70 is a formed cavity that is securely fitted and affixed to the interior side of the liner 60 as shown in FIG. 1 and FIG. 6. FIG. 8 shows a sectional view of the bristle fabric 70. The paint retaining fabric 70 may be adhered by hook and loop fasteners 62 for removal and cleaning.

The bristle fabric 70 is a commercially available paint retaining material typically used on paint application devices and is a fabric like material comprising a short bristle filament or like material.

A paint pad material, such as a flocked material, acrylic canvas pad, open cell foam material, a memory foam, sponge, woven carpet or similar like materials may be used in place of the bristle fabric 70.

In the preferred embodiment, the bristle fabric 70 may have an adhesive backing for quick assembly and attachment. In a second embodiment shown in FIG. 9 the bristle fabric is supplied in a die cut sheet form. A fitted circular section 78 is affixed to the interior of the bottom of the interior cavity 80 and a matching cut strip 75 is affixed to the interior of the outer edge of the liner 60.

Figure 9:
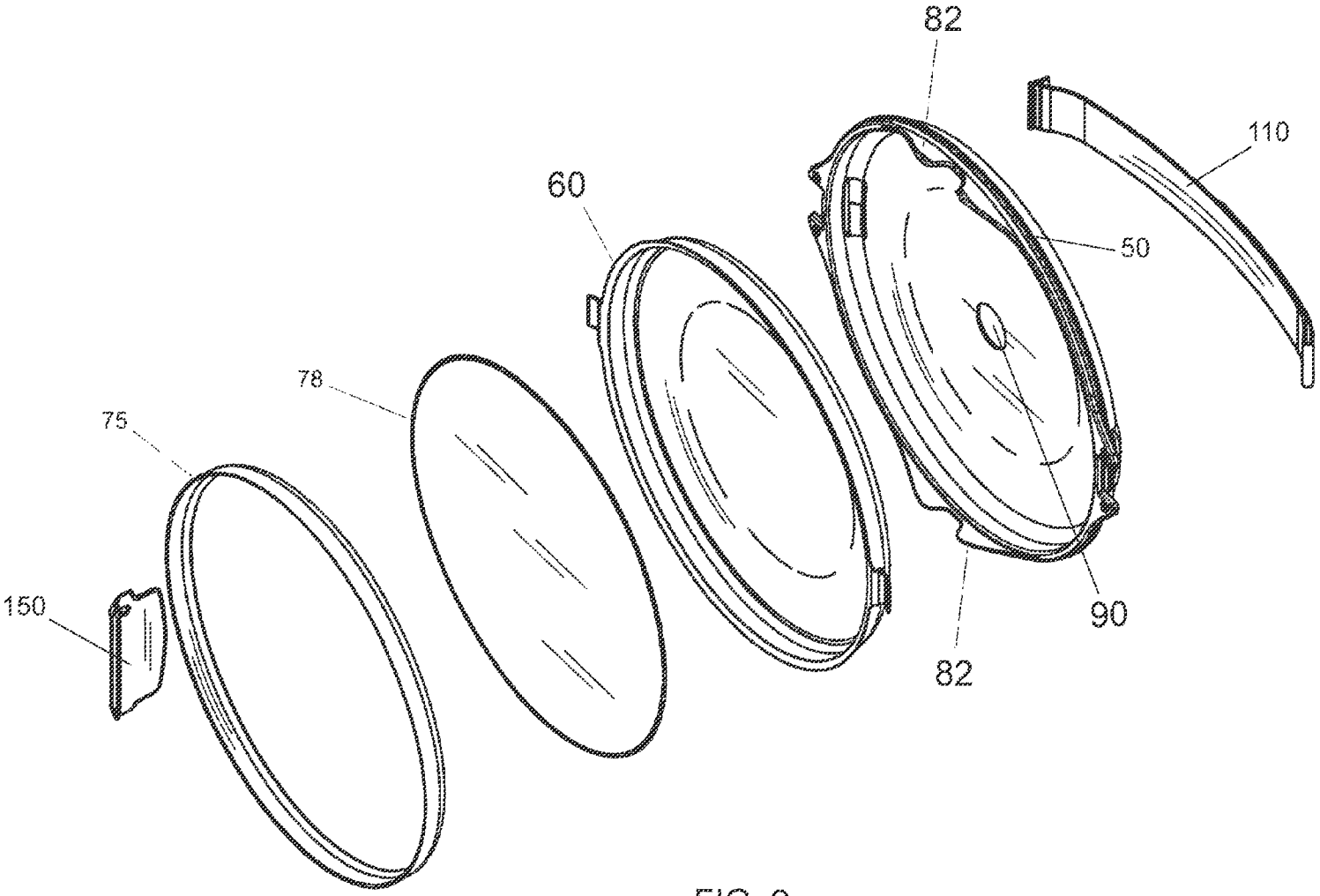
FIG. 9 is an exploded perspective view showing a second embodiment.

Additionally, in a second embodiment, a pair of extended wall sections 82 may be added to the sidewall 50 and shaped accordingly to support a brush handle from sliding, shown in FIG. 9. The pair of extended wall sections 82 are each placed at a ninety degree angle from a snap-in mechanism of the liner 60.

Although the preferred embodiment allows for a liner 60 fitted into the open-top circular structure 20, the paint palette system 10 may be used without a liner 60 and bristle fabric 70 may be applied directly into the open receptacle 30. The liner 60 allows for more functionality and easier cleaning.

Figure 3:
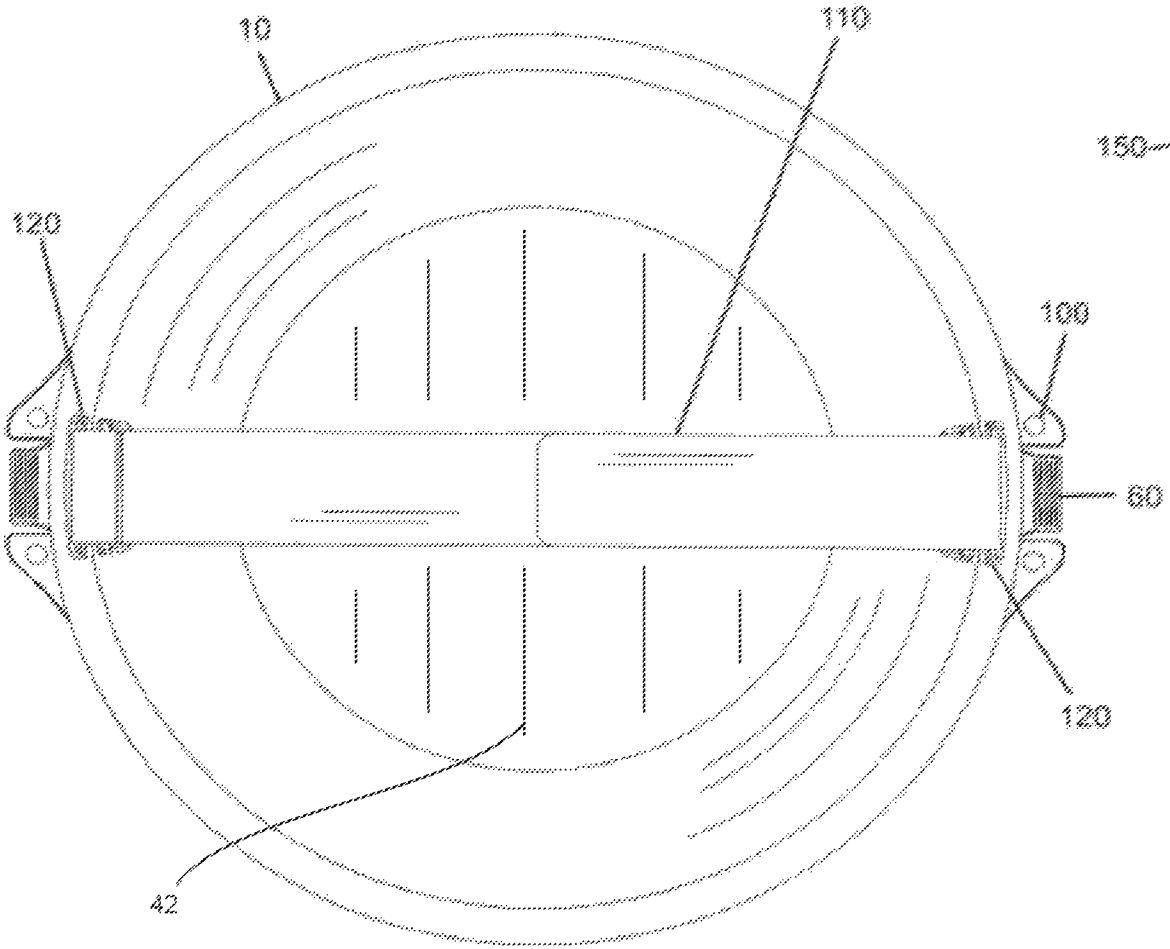
FIG. 3 is a bottom plan view.

The open receptacle 30 shall be preferably constructed of a semi rigid plastic or like material comprising a substantially flat bottom base 40 with enclosing sidewalls 50 shown in FIG. 3. Sidewalls 50 preferably formed in a concave shape or similar shape as best seen in FIG. 3.

Sidewalls 50 shall be rigid and may be outwardly inclined or angular in shape with complementary design features for securely receiving and fitting liner 60. Sidewall 50 may in some embodiments have a guide rigid 140 that may be used for additional add-on tools such as a paint squeegee 150.

The open receptacle 30 shall have a central opening 90 in the central base of the bottom section in embodiments that require a liner 60 for ease in removing the liner 60. In embodiments without the liner 60 an opening is not required.

The flat bottom base 40 shall be constructed of a rigid material and may have on the exterior bottom side extruded design features 42 to better grip a surface that may include extruded feet or gripping ridges. The bottom 40 may additionally be slightly depressed in reference to sidewalls 50. The base interior may have a rough textured surface 44 for holding paint.

Some embodiments of the invention may include a formed attachment for attaching brushes, tools, and other utility items that may be used by an amateur or commercial painter and feature attachment opening 100 shall be included on the paint palette system 10 for future features.

Figure 4:
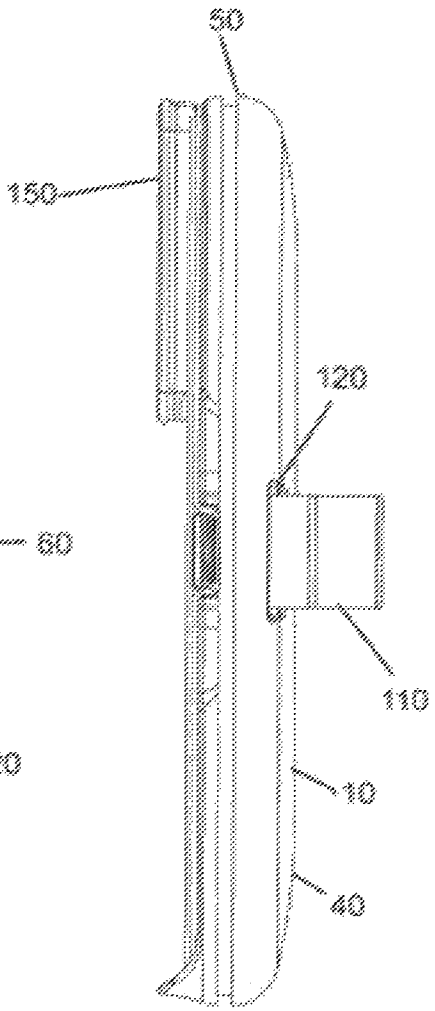
FIG. 4 is an end view taken from FIG. 3, the opposite side being a mirror image.

The paint palette system 10 shall also have a handle 110 extending across the length of the flat bottom base 40 and shall be affixed by a plurality of fastening support extrusions 120 shown in FIG. 3, FIG. 4, and FIG. 8.

In one embodiment, handle 110 may be threaded thru a complementary receiving ring 130 as shown in FIG. 8. Handle adjustable options may include D-Ring, strap adjustment connectors or hook and loop fasteners (e.g., VELCRO) adjustment means.

In other embodiments, handle 110 may not be adjustable and be affixed directly to the flat bottom base 40. For example, the handle 110 may be affixed by glue, snaps, or fastening commercially available hardware. Handle 110 may also be removable for replaceable as required.

Handle 110 shall be constructed of a flexible material and may be made of a durable cloth fabric or like material. In other embodiments a flexible plastic or rubber like material may be used. Handle 110 may also include metal or plastic ends for secure attachment to handle receiving connections (Not Shown).

The handle 110 shall be designed to easily facilitate handling and transportation. Additionally, the handle may also act as a gripping component and keep the paint palette system 10 from sliding off a steep incline such as a roof or like surface.

In use the paint palette system 10 is utilized by pouring paint into the open receptacle 30 and then sliding the users hand between the strap handle 110 and flat bottom base 40. The paint palette system 10 may then be used to dispense paint to a paint brush or like tool. The paint palette system 10 may be used at any angle and has been tested while upside down without paint spillage.

The paint palette system 10 in the preferred embodiment includes a small attached paint squeegee 150 that helps pull all the paint from the bristle fabric 70. The squeegee 150 may also be used as a hard paint separator.

In use the paint palette system 10 may have multiple colors of paint in the open receptacle 30 or liner 60 and the paint colors will not run together. In use it has also been discovered that multiple brushes can also be carried using the strap handle 110.

In between uses, the paint palette system 10 may be easily stored in a readily available 1½ gallon sealable plastic bag (Not Shown) and may be easily stacked when multiple paint palette systems 10 are used.

Additionally, multiple liners 60 may be stored in plastic bags and may be interchangeably inserted into the open receptacle 30 in cases where many different paint colors are utilized and this offers the user a simpler way to view and use multiple colors.

In some embodiments a plastic divider may be inserted into the liner 60 and may be used to better separate paint colors or materials that may be utilized. The paint palette system 10 may additionally be used for other materials besides paints where a hard divider is required to keep separate material apart such as glue and paint.

Although applicant has described applicant's preferred embodiment of this invention, it will be understood that the broadest scope of this invention includes such modifications as diverse shapes and sizes and materials. Such scope is limited only by the below claims as read in connection with the above specification. Further, many other advantages of applicant's invention will be apparent to those skilled in the art from the above descriptions and the below claims.

From the foregoing, it will be apparent that the present invention provides for a novel and improved paint palette system 10 and whereas the present invention has been described in a particular fashion, it should be understood that other and further modifications apart from those shown or suggested herein may be made within the scope of the invention.

What is claimed is:

1. A paint palette comprising:

a flat bottom base comprising an interior side, an exterior side, and a perimeter;

sidewalls comprising an inner side and an outer side, the sidewalls extending from the perimeter of the flat bottom base in a direction of the interior side of the flat bottom base, the inner side of the sidewalls and the interior side of the flat bottom base forming a cavity; and paint retaining bristle fabric comprising a fabric-like material having a bristle filament, the paint retaining bristle fabric coupled to and entirely covering the interior side of the flat bottom base within the cavity.

2. The paint palette of claim 1, comprising a liner disposed on an entirety of an interior side of the flat bottom base, wherein the paint retaining bristle fabric is affixed to the liner and coupled to the flat bottom base by the liner.

3. The paint palette of claim 2, wherein the paint retaining bristle fabric is affixed to the liner by hook and loop fasteners.

4. The paint palette of claim 2, wherein the liner is detachably coupled to the sidewalls.

5. The paint palette of claim 4, wherein the flat bottom base comprises a central opening extending through the flat bottom base.

6. The paint palette of claim 5, wherein the liner is removable from the cavity by at least the central opening.

7. The paint palette of claim 1, wherein the sidewalls are concave.

8. The paint palette of claim 1, wherein the sidewalls are perpendicular to the flat bottom base.

9. The paint palette of claim 1, wherein the sidewalls extend outwardly at a 15 degree angle.

10. The paint palette of claim 1, wherein one or both of the interior side and the exterior side of the flat bottom base comprises a rough textured surface.

11. The paint palette as claimed in claim 1, wherein the exterior side of the flat bottom base comprises extruded feet.

12. The paint palette of claim 1, comprising a handle extending across a width of the flat bottom base.

13. The paint palette of claim 12, wherein the flat bottom base comprises fastening support extrusions, and wherein the handle is fitted through the fastening support extrusions.

14. The paint palette of claim 12, wherein the handle is affixed to the sidewalls on opposite ends of the flat bottom base.

15. The paint palette of claim 12, wherein the handle is non-adjustable.

16. The paint palette of claim 12, wherein the handle comprises rigid connectable ends.

17. The paint palette of claim 1, wherein the sidewalls form a circular shape.

18. The paint palette of claim 1, wherein the sidewalls comprise at least one extended wall section configured to hold a paintbrush.

19. The paint palette of claim 1, comprising one or both of:

a squeegee, and a snap on lid configured to detachably couple to the sidewalls.

20. The paint palette of claim 1, wherein when the paint retaining bristle fabric is loaded with paint, the paint retaining bristle fabric retains the paint without spillage when the cavity is facing down to ground.

* * * * *